United States Patent [19]

Speich

[11] 3,949,788

[45] Apr. 13, 1976

[54] WEB WEAVING MACHINE WITH SEVERAL HEALD SHAFTS

[75] Inventor: Francisco Speich, Frick, Switzerland

[73] Assignee: Jakob Muller Forschungs-und Finanz AG, Switzerland

[22] Filed: Oct. 24, 1974

[21] Appl. No.: 517,591

[30] Foreign Application Priority Data

Nov. 22, 1973 Switzerland ..... 16465/73

[52] U.S. Cl. ..... 139/57; 139/79

[51] Int. Cl.[2] ..... D03C 13/00; D03C 5/00

[58] Field of Search ..... 139/79–81, 139/32, 55, 57, 58, 82

[56] References Cited

UNITED STATES PATENTS

| | | | |
|---|---|---|---|
| 734,834 | 7/1903 | Draper | 139/79 |
| 1,718,198 | 6/1929 | Almond | 139/79 X |
| 2,705,507 | 4/1955 | Moon | 139/79 |
| 3,152,619 | 10/1964 | Bulley et al. | 139/58 |
| 3,603,351 | 9/1971 | Piazzolla | 139/79 |
| 3,796,235 | 3/1974 | Muller | 139/79 |

FOREIGN PATENTS OR APPLICATIONS

| | | | |
|---|---|---|---|
| 16,767 | 1894 | United Kingdom | 139/79 |
| 593,847 | 3/1934 | Germany | 139/79 |
| 1,499,397 | 9/1967 | France | 139/57 |
| 722,446 | 7/1942 | Germany | 139/79 |

*Primary Examiner*—James Kee Chi

*Attorney, Agent, or Firm*—McGlew and Tuttle

[57] ABSTRACT

A web weaving machine is disclosed. The machine comprises a plurality of heald shafts disposed to have a plane of symmetry common to one another and a plurality of tension transmitting elements. At least one of the elements is flexible and is guided by at least one roller. Each tension transmitting element is connected to a respective heald shaft at a portion thereof which is disposed in the plane of symmetry and each element is so disposed as, in use, to transmit a force to the respective heald shaft which is directed substantially parallel to the healds thereof.

9 Claims, 4 Drawing Figures

WEB WEAVING MACHINE WITH SEVERAL HEALD SHAFTS

BACKGROUND OF THE INVENTION

In known weaving machines, every heald shaft or heddle of such machine is moved by a pair of lever elements, wherein these lever elements engage the respective heald shafts in the proximity of the two lateral ends thereof. The two lever elements belonging to a heald shaft are in that case connected by transmission elements in such a manner, that they both perforce execute the same motion and exert a pulling or pushing force on the heald shaft parallel to the healds. This construction is however relatively expensive because of the transmission elements necessary for the simultaneous movement of the two lever elements.

There is further already known a web machine with several heald shafts arranged one behind the other, in which only a single lever engages with each heald shaft. In this construction, the pivot axes of the lever elements extend perpendicularly to the healds but parallel to the general planes of the respective heald shaft assembly. Since the lever elements in such a known arrangement are arranged next to one another, they cannot all engage with the heald shafts in the middle thereof. This has the consequence, that the lever elements generate turning moments with respect to the centres of the respective heald shaft assemblies, whereby excessive loading of the lateral guides of the heald shafts may arise. This causes, particularly at great weaving speeds, on the one hand excessive wear of such guides and on the other hand the generation of excessive noise.

SUMMARY OF THE INVENTION

According to the present invention there is provided a web weaving machine comprising a plurality of heald shafts disposed to have a plane of symmetry common to one another and a plurality of tension transmitting elements, at least one of the elements being flexible and being guided by at least one roller, each tension transmitting element being connected to a respective heald shaft at a portion thereof which is disposed in the plane of symmetry and each element being so disposed as, in use, to transmit a force to the respective heald shaft which is directed substantially parallel to the healds thereof.

BRIEF DESCRIPTION OF THE DRAWINGS

Embodiments of the present invention will now be more particularly described with reference to the accompanying drawing, in which.

DESCRIPTION OF PREFERRED EMBODIMENT

Figure 1:
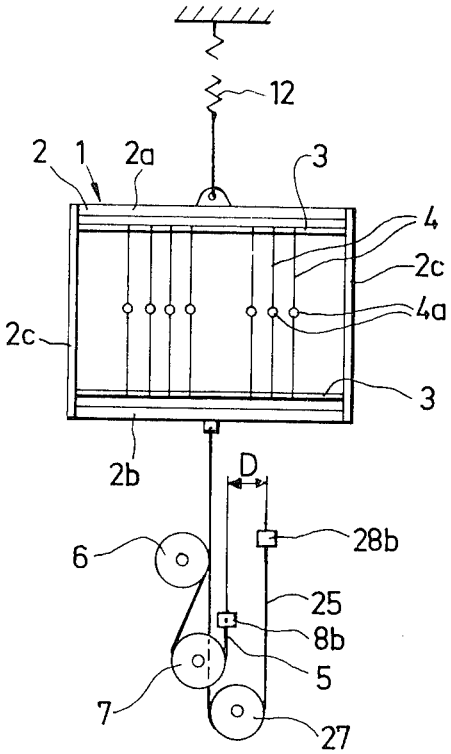
FIG. 1 shows an elevational view, in a direction parallel to the warp threads, of a web weaving device which includes a plurality of heald shafts and in which the pivot axes of transmission levers for imparting displacement to such heald shafts extend parallel to the general planes of the respective heald shaft assemblies.
Figure 2:
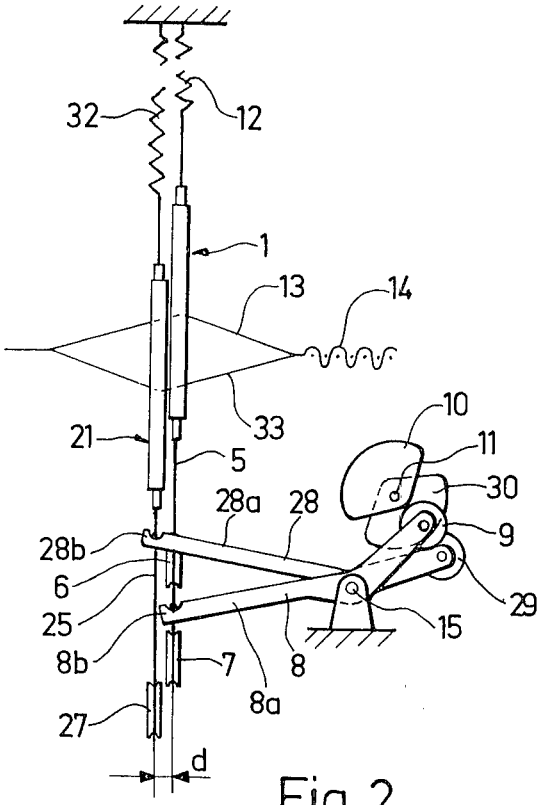
FIG. 2 shows a side elevational view of the device shown in FIG. 1.

Illustrated in FIGS. 1 and 2 is part of a weaving loom including two heald shaft assemblies designated generally by the reference numerals 1 and 21, respectively, wherein the heald shaft 21 has been omitted in FIG. 1 in the interest of clarity of illustration. The heald shaft assembly 1 includes a heald shaft frame 2, which is provided with two horizontal shaft rods 2*a* and 2*b*, respectively, which are connected with one another by two side members each designated by the reference 2*c*. Parallel to the shaft rods 2*a* and 2*b* are arranged two heald carriers 3, on which several vertically extending healds 4 are supported. As shown in FIG. 1, each heald 4 is provided with a respective central eyelet 4*a*. During weaving, the warp threads 13 are guided through these eyelets 4*a*.

At each of the heald shafts 1 and 21, a tension element 5 and 25, respectively, engages with the lower shaft rod in such a way that the respective heald shaft assembly must inevitably follow any movement of the tension element 5 or 25. Both tension elements 5 and 25 are connected to the heald shafts 1 and 21, respectively, in the plane of shaft symmetry which is common to both the heald shafts 1 and 21. Thus, each tensioning element 5 and 25 extends in a direction parallel to the healds 4 and each is so arranged that the tension force exerted on the respective heald shaft at the point of engagement operates in a direction parallel to the healds 4. The tension elements 5 and 25, formed somewhat like ropes, are flexible and are each guides over at least one deflecting roller 6, 7 and 27, respectively.

Associated with each of the heald shafts 1 and 21 is a transmission lever 8 and 28, respectively, of which in FIG. 1 only the one lever arm end 8*b* and 28*b*, respectively, is illustrated. The lever arms 8*b* and 28*b* are connected to the tension elements 5 and 25, respectively. As shown in FIGS. 1 and 2, the levers 8 and 28 are arranged side-by-side and are pivotable about a common pivot axis 15 extending perpendicularly to the plane of symmetry of the heald shafts 1, 21. As shown best in FIG. 2, the lever arms 8*a* and 28*a* — when in their central positions — each extend substantially perpendicularly to the healds 4. At the other ends of the transmission levers 8 and 28 are mounted rollers 9 and 29, respectively. The rollers 9 and 29 serve as sensing elements, which rest upon the camming profiles of cam discs 10 and 30, respectively.

Each of the heald shafts 1 and 21 is guided in such a manner by guide means (not shown) that the respective heald shafts may each be moved in a vertical direction, but are restrained from twisting or lateral displacement. At each of the heald shafts 1 and 21 there engages a respective restoring spring 12 and 32, respectively. As shown best in FIG. 1, each of these restoring springs engages a part of the respective heald shaft which is disposed opposite to the point of engagement of the tension elements 5 and 25, respectively. These springs 12 and 32 are so arranged, that the force generated by them is directed parallel to the healds 4 and operates on the heald shafts 1 and 21, respectively, in the plane of symmetry of the respective heald shafts. Instead of one, several restoring springs can also be engaged with each of the heald shafts, provided that such a plurality of springs are so arranged that the resultant force generated operates in the plane of symmetry so as not to tend to twist the heald shafts.

When now bearing shaft 11, with which the cam discs 10 and 30 are connected to be rotationally secure, turns during weaving, the levers 8 and 28, respectively, execute periodical pivot movements, which are transmitted by the tension elements 5 and 25, respectively, to the shafts 1 and 21, respectively. Since the lever arm 28*a* of the lever 28 is somewhat longer than the lever arm 8*a* of the lever 8, the deflection of the heald shaft 21 is somewhat larger than that of the heald shaft 1. Since the heald shaft 21 is somewhat more remote from the edge of the woven fabrics 14 than the heald shaft 1, the angle between the woven fabric 14 and the warp threads 13 guided through the heald eyelets of the heald shaft 1 in both end positions of the heald shaft 1 is about the same as the angle between the woven fabric 14 and the warp threads 33 guided through the eyelets of the heald shaft 21.

Due to the fact that the tension element 5 is deflected by two deflecting rollers 6 and 7 and the tension element 25 is deflected by the deflecting roller 27, both tension elements 5 and 25 can be connected to the respective heald shafts in the plane of shaft symmetry, although the transmission levers 8 and 28 are arranged side-by-side and their lateral spacing D (FIG. 1) is larger than the spacing *d* (FIG. 2) between the respective heald shafts. The embodiment of the invention illustrated in FIGS. 1 and 2 thus makes it possible to impart motion to the heald shafts without the different forces operating on each heald shaft — namely the force transmitted by the tension element, the force generated by the restoring spring and the frictional forces generated by the guide elements — producing a turning moment with respect to the centre of the respective heald shafts. Thus, frictional losses, the wear of the guides and generation of noise are appreciably reduced compared to those of some known arrangements.

More than two heald shafts can of course be arranged one behind the other and each may be connected, in the manner illustrated in the FIGS. 1 and 2, by flexible tension transmitting elements to respective transmission levers. It is in that case also possible, that one of the transmission levers is disposed in the plane of symmetry of the respective heald shaft. Such a lever may be connected directly, that is to say without a deflecting roller, to the respective heald shaft, or may be connected thereto via a rigid or flexible tension transmitting element. It is further possible to arrange the transmission levers corresponding to the respective heald shafts above one another instead of arranging them side-by-side next to one another and mounting them by means of a common shaft. Similarly, the respective cam discs may be arranged above one another instead of being mounted side-by-side on a common shaft. Furthermore, movement of the heald shafts can be controlled by any suitable camming means. Thus, for example, reciprocatably displaceable camming elements may be employed instead of rotatable cam discs.

Figure 3:
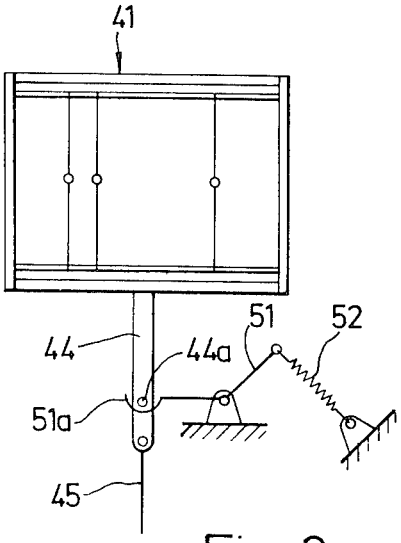
FIG. 3 shows a representation of a heald shaft, in which a tensioning element and a restoring element engage on the same side of the heald shaft assembly.

Illustrated in FIG. 3 is a heald shaft 41, at which a flexible tension element 45 and a restorer engage on the same side of the shaft in a plane of shaft symmetry. The tension element 45, of which only the uppermost end portion has been illustrated, is connected to a vertical rod 44, which is attached to the heald shaft 41. The restorer consists of a resetting lever 51 and a tension spring 52. The free end 51*a* of the resetting lever 51 engages a peg 44*a* attached to the rod 44 and urges the heald shaft 41 upwardly in FIG. 3. In such an arrangement, the transmission lever and the cam disc which are not shown in FIG. 3 are constructed and arranged in a manner similar to that illustrated in the FIGS. 1 and 2. As in FIGS. 1 and 2, a plurality of heald shafts and associated transmission levers and cams may be provided. It is of course also possible to omit the tension spring 52 and to load each resetting lever 51 with a weight, in order to provide a restoring force for the corresponding heald shaft.

Figure 4:
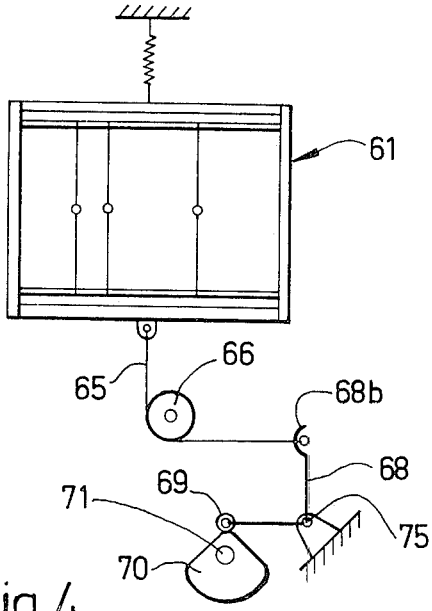
FIG. 4 shows a simplified representation of a heald shaft assembly in which the pivot axis of the transmission lever extends perpendicularly to the general plane of the heald shaft frame.

Illustrated in FIG. 4 is an embodiment, in which associated with each heald shaft 61 is a transmission lever 68, the pivot axis 75 of which extends parallel to the plane of the heald shaft 61 symmetry, the one end 68*b* of which is connected to the tension transmitting element 65 which is connected to the shaft 61 and at the other end of which is mounted a roller 69 serving as cam follower. The roller 69 rests on the curve of camming surface of a cam disc 70, which is connected to be rotationally fast with a shaft 71. This embodiment has the advantage, that only one deflecting roller is necessary per tension element 65 for all the heald shafts, such as the heald shaft 61, arranged one behind the other, whilst, when the transmission levers of a heald shaft displacement device with more than two heald shafts are so arranged as in the example of embodiment illustrated in the FIGS. 1 and 2, two deflecting rollers for deflection of the tension transmitting element are necessary for most of the heald shafts. Since the transmission levers and cam discs are relatively broad, the embodiment illustrated in FIG. 4 has however the disadvantage, that the heald shafts likewise must be arranged to be correspondingly spaced far apart from one another or that the transmission levers must be divided into two groups. In the latter case, the two trasmission lever groups can be arranged substantially above one another and the shafts following one upon the other can be connected by a respective tension element alternatingly with a respective lever of the one or the other group.

What I claim is:

1. A web weaving machine comprising, in combination, a support; a plurality of heald shafts each mounted to be displaceable relative to said support, said heald shafts being disposed to have a plane of symmetry common to said plurality; a plurality of healds supported on each said heald shaft in mutually parallel spaced relationship; at least one deflector roller rotatably mounted on said support; a plurality of tension transmitting elements, at least one of said elements being flexible and being guided by said at least one roller, an end portion of each said tension transmitting element being disposed to be substantially parallel to said healds and being connected to a respective one of said heald shafts at a portion thereof which is disposed in said plane of symmetry, a single tension member connected centrally to each of said support, and restoring means acting on said support to return it in an opposite direction.

2. A web weaving machine as defined in claim 1, wherein each of said tension elements is flexible and is guided by at least one deflector roller.

3. A web weaving machine as defined in claim 1, comprising a plurality of pivotally mounted double-armed levers and a plurality of camming means, one arm of each said double-armed lever being connected to a respective one of said tension transmitting elements and the respective other arm of each said double-armed lever being provided with sensing means contacting a respective one of said camming means, the pivotal axis of each said double-armed lever extending substantially perpendicularly to said plane of symmetry.

4. A web weaving machine as defined in claim 3, wherein each of said camming means comprises a rotatably mounted cam disc.

5. A web weaving machine as defined in claim 1, comprising a plurality of pivotally mounted double-armed levers and a plurality of camming means, one arm of each said double-armed lever being connected to a respective one of said tension transmitting elements and the respective other arm of each said double-armed lever being provided with sensing means contacting a respective one of said camming means, the pivotal axis of each said double-armed lever extending substantially parallel to said plane of symmetry.

6. A web weaving machine as defined in claim 5, wherein each said camming means comprises a rotatably mounted cam disc.

7. A web weaving machine as defined in claim 1, comprising restoring means connected to each said heald shaft, an end portion of each said restoring means being disposed to be substantially parallel to said healds thereof and being connected to the side of said respective heald shaft opposite to said portion thereof at which the respective one of said tension transmitting elements is connected, whereby the force exerted by said restoring means on each said heald shaft acts along a line in said plane of symmetry.

8. A web weaving machine as defined in claim 7, wherein each said restoring means comprises a plurality of restoring springs.

9. A web weaving machine as defined in claim 1, comprising restoring means connected to each of said heald shaft, an end portion of each said restoring means being disposed to be substantially parallel to said healds and being connected to the same side of said heald shaft as that at which the respective one of said tension transmitting elements is connected, whereby the force exerted by said restoring means on each said heald shaft operates in said plane of symmetry.

* * * * *